US006814817B2

(12) United States Patent
Van Houten et al.

(10) Patent No.: US 6,814,817 B2
(45) Date of Patent: Nov. 9, 2004

(54) STEEL STRAP COMPOSITION

(75) Inventors: Jon E. Van Houten, Valparaiso, IN (US); Dennis A. Miller, Schaumburg, IL (US); Rainer Kammer, Dinslaken (DE); Erich Kruse, Wesel (DE)

(73) Assignee: Illinois Tool Works, Inc., Glenview, IL (US)

( * ) Notice: Subject to any disclaimer, the term of this patent is extended or adjusted under 35 U.S.C. 154(b) by 140 days.

(21) Appl. No.: 10/314,764

(22) Filed: Dec. 9, 2002

(65) Prior Publication Data

US 2004/0108026 A1 Jun. 10, 2004

(51) Int. Cl.[7] ..... C22C 38/02; C22C 38/04; C21D 8/02

(52) U.S. Cl. ..... 148/320; 148/148; 148/603; 148/602; 148/661

(58) Field of Search ..... 148/320, 602, 148/603, 652, 651, 661, 660; 420/8

(56) References Cited

U.S. PATENT DOCUMENTS 3,311,512 A * 3/1967 Mohri et al. ..... 148/635
3,421,951 A * 1/1969 Shelton ..... 420/8
3,551,216 A 12/1970 Severing et al.
5,516,373 A * 5/1996 Dries et al. ..... 148/320
5,542,995 A * 8/1996 Reilly ..... 148/630
6,635,127 B2 * 10/2003 Doonan et al. ..... 148/320

FOREIGN PATENT DOCUMENTS

EP 0684319 B1 1/1999
JP 407300617 * 11/1995 ..... C21D/8/00

OTHER PUBLICATIONS

Japanese Publication 2001073081; Published Mar. 21, 2001, Abstract.
European Patent Office Communication and Search Report Apr. 13, 2004.

* cited by examiner

*Primary Examiner*—Deborah Yee
(74) *Attorney, Agent, or Firm*—Mark W. Croll, Esq.; Donald J. Breh, Esq.; Welsh & Katz, Ltd.

(57) ABSTRACT

A heat treated steel strap usable in a strapping machine has a tensile strength of at least about 170 KSI, and an elongation of at least about 6.5 percent. The steel strap is fabricated from a coiled steel reduced by cold rolling. The strap has a composition of 0.30 to 0.36 percent carbon, 0.90 to 1.25 percent manganese, and 0.75 to 1.10 percent silicon. The strap is heated to a temperature of about 815° C. to about 900° C. and quenched to a temperature of about 370° C. to about 510° C. The strap has a seal joint break strength of about 4350 pounds when the strap has a width of about one inch and a thickness of 0.030 inches. A method for forming the strap is also disclosed.

9 Claims, No Drawings

STEEL STRAP COMPOSITION

BACKGROUND OF THE INVENTION

The present invention pertains to steel strap. More particularly, the present invention pertains to a composition of a cold rolled high tensile strength steel and a method of making strap for use in strapping machines for providing a tensioned loop about packaged articles.

Articles are often packaged in a bundle, on a pallet or in a crate for shipping, storage and merchandising. Many times, such bundled articles are secured with a steel or polymer strap applied in a tensioned loop by an automatic or manually operated strapping machine. Some applications, and in particular those applications in which the strap secures a package having substantial weight such as a stack of bricks, lumber and the like, require the use of a steel strap which has high tensile strength and is less susceptible to deterioration by abrasion than polymer and existing metal strap. Further, although certain existing steel strap is readily applicable to heavy packaged articles having cylindrical shapes and otherwise smooth or obtuse surfaces, there are limitations on the extent to which it can be formed under tension over and around sharp edges and corners of a package.

More specifically, packages having sharp edges or corners with a small radius of curvature, for example a 90 degree corner, pose a problem for existing steel strap because the strap is subject to tremendous stress and strain as the strap tension is increased to an extent necessary to secure the packaged article. This stress and strain frequently causes the strap to fracture proximate to the edge or corner of the packaged article. In particular, the relatively low ductility of non-heat treated strap contributes to the failure of strap used in this application. Moreover, controlled strap elongation (prior to failure) also helps alleviate these problems when the strap is applied and tensioned with an automatic strapping machine which generates a high tension in a short time interval during a rapid strap application process.

Many practices have been developed to reduce strap failure, such as reducing the tension applied to the strap or placing a shield between the articles to be bundled and the strap. However, reducing strap tension may result in insecurely packaged articles and the use of shields requires an additional step that is time consuming and can be labor intensive, thus increasing costs. As such, these practices are not practical for long term, cost efficient strapping operations.

The physical properties of the steel from which the strap is formed determine the tensile strength and elongation of the strap. Iron based materials suitable for steel strap generally include carbon which is added to the steel to increase the tensile strength of the strap. The addition of carbon however also tends to increase steel embrittlement which decreases steel formability and, accordingly, the ability of steel strap to be formed over and around corners without fracturing.

Another factor that increases steel embrittlement is free nitrogen. It has been found that the addition of elements such as titanium, zirconium and boron to steel will scavenge free nitrogen, that is, remove detrimental amounts of free nitrogen from the steel by reacting with the free nitrogen to form titanium nitride, zirconium nitride, or boron nitride, respectively. The removal of free nitrogen results in improved formability and ductility, decreased work hardening and the elimination of nitrogen related strain aging. The formation of nitrides of titanium and zirconium, however, are known to cause fracture of the steel matrix during cold reduction, and to decrease residual ductility in full hard cold rolled steels. Further, the addition of nitrogen scavenging elements in amounts in excess of that required for free nitrogen scavenging will increase the hardenability and decrease the formability of the steel, and further additions may result in embrittlement.

It is also known that reduction of steel by cold working increases steel tensile strength. As such, the carbon content can be reduced while still maintaining a fixed tensile strength. However, the reduction of steel by cold working also increases steel embrittlement and decreases steel formability. In applications where steel formability is important, therefore, reduction by cold working has been performed to a limited extent to avoid embrittlement and the consequent loss in steel formability.

The tensile strength of steel can be increased or improved by alloying with other elements, or by heat treatment. However, alloying can be relatively costly, and is not generally an appropriate solution to the problems associated with steel strapping. Heat treating on the other hand, while increasing the tensile strength typically also reduces the ductility and increases the brittleness of the material. Thus, although the tensile strength is increased, the joint strength may be reduced due to the susceptibility of the material to fail at the joint.

In a typical use, the strap is joined or sealed onto itself without the use of a secondary element, such as a separate seal. One known sealless joint or connection is that illustrated in U.S. Pat. No. 4,825,512 to Tremper et al., which patent is incorporated herein by reference. The sealless connection uses notches that are cut into the upper and lower (i.e., overlapping) layers of strap to lock the layers to one another. One problem with this type of connection is that as the tensile strength of the material is increased, it has been found that the area of the material surrounding the notches is susceptible to cracking or failure, thus reducing the joint strength.

Accordingly, there is a need for a high tensile strength material suitable for use in making steel strap. Desirably, such a strap material has a high tensile strength and high elongation prior to failure. Most desirably, such a strap material provides this increased tensile strength while maintaining high joint strength.

BRIEF SUMMARY OF THE INVENTION

A heat treated steel strap usable in a strapping machine has a tensile strength of at least about 170 KSI, and preferably about 180 KSI, and an elongation of at least about 6.5 percent. The steel strap is fabricated from a coiled steel reduced by cold rolling. The steel strap has a composition of 0.30 to 0.36 percent carbon, 0.90 to 1.25 percent manganese, and 0.75 to 1.10 percent silicon.

The strap is heated to a temperature of about 815° C. to about 900° C. and quenched to a temperature of about 370° C. to about 510°C. The strap has a seal joint break strength of about 4350 pounds when the strap has a width of about one inch and a thickness of 0.030 inches.

A method for making the high strength strap includes the steps of forming a steel strap having a composition of 0.30 to 0.36 percent carbon, 0.90 to 1.25 percent manganese, and 0.75 to 1.10 percent silicon, heating the strap to a temperature of about 815° C. to about 900° C. and quenching the heated strap to a temperature of about 370° C. to about 510°C. The heat treated and quenched strap has a tensile strength of at least about 170 KSI, and an elongation of at least about 6.5 percent. The strap has a seal joint break strength of about 4350 pounds when the strap has a width of about one inch and a thickness of 0.030 inches.

In a current method, the strap is preheated to a temperature of about 370° C. to about 510° C. prior to the heating step. The steel strap is cold rolled prior to the heating step.

These and other features and advantages of the present invention will be apparent from the following detailed description, in conjunction with the appended claims.

DETAILED DESCRIPTION OF THE INVENTION

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated. It should be further understood that the title of this section of this specification, namely, "Detailed Description Of The Invention", relates to a requirement of the United States Patent Office, and does not imply, nor should be inferred to limit the subject matter disclosed herein.

A strap material in accordance with the present invention is usable in a both manual and automatic strapping machines. The strap material is formed in a heat treating process. The material has a tensile strength of about 180 thousand pounds per square inch (KSI), and an elongation of at least about 6.5 percent before failure. The steel strap material is fabricated from a coiled steel reduced by cold rolling.

The steel strap composition includes 0.30 to 0.36 percent carbon, 0.90 to 1.25 percent manganese, and 0.75 to 1.10 percent silicon. In a heat treating process, the strap is heated to a temperature of about 815° C. to about 900° C. and quenched to a temperature of about 370° C. to about 510°C. Preferably, strap is preheated to a temperature of about 370° C. to about 540° C. prior to heating, heated and subsequently quenched.

A strap in accordance with the present invention has a minimum tensile strength of about 170 KSI (about 1180 mega pascals (MPa)) and preferably about 180 KSI (1250 MPa) and a seal joint break strength of about 4350 pounds.

Those skilled in the art will recognize that the minimum tensile strength of about 170 KSI is quite high and would otherwise, generally indicate that the joint strength would be compromised due to embrittlement of the material. It has surprisingly been found that the addition of silicon in an amount of about 0.75 to about 1.10 percent by weight of the material tends to reduce the embrittlement that the material would otherwise exhibit.

It has been found that a strap in accordance with the present invention can be made in smaller widths than presently made strap, and still maintain high break strength and joint break strength. It has been found that strap in accordance with the present invention having a width of one inch and a thickness (gauge) of 0.030 inches has a break strength of 5800 pounds (185 KSI) and a seal joint break strength of about 4350 pounds.

Without being bound to theory, it is believed that the addition of silicon in an amount of about 0.75 to about 1.1 percent alleviates the tendency for the steel to embrittle by promoting the ferrite phase of the material structure. Conversely, the inclusion of silicon tends to deter the material from austenizing (i.e., forming an austenitic phase).

One hundred sixty-five (165) samples of strap material were subjected to tensile strength testing. The strap samples had a maximum tensile strength as tested of 208.1 KSI, a minimum tensile strength as tested of 172 KSI and a mean tensile strength of 185 KSI. The samples tested were strap material as provided above, having a one inch width and a thickness of 0.030 inches. In the samples that were tested, the composition of the material varied with the composition being: carbon between about 0.31 and 0.34 percent; manganese between about 0.98 and 1.10 percent; phosphorus between about 0.009 and 0.020 percent; sulfur between about 0.001 and 0.009 percent; silicon between about 0.99 and 1.05 percent; and aluminum between about 0.027 and 0.045 percent.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A heat treated steel strap usable in a strapping machine, the steel strap having a tensile strength of at least about 170 KSI, and an elongation of at least about 6.5 percent, the steel strap fabricated from a coiled steel reduced by cold rolling, the steel strap composition comprising: 0.30 to 0.36 percent carbon, 0.90 to 1.25 percent manganese, and 0.75 to 1.10 percent silicon, the strap being heated to a temperature of about 815° C. to about 900° C. and quenched to a temperature of about 370° C. to about 510° C., the strap having a seal joint break strength of about 4350 pounds when the strap has a width of about one inch and a thickness of 0.030 inches.

2. The strap in accordance with claim 1 wherein the strap is preheated to a temperature of about 370° C. to about 510° C. prior to heating.

3. The strap in accordance with claim 1 wherein the tensile strength is about 180 KSI.

4. A heat treated steel strap usable in a strapping machine, the steel strap having a tensile strength of at least about 170 KSI, and an elongation of at least about 6.5 percent, the steel strap fabricated from a coiled steel reduced by cold rolling, the steel strap composition consisting essentially of: 0.30 to 0.36 percent carbon, 0.90 to 1.25 percent manganese, and 0.75 to 1.10 percent silicon, the strap being heated to a temperature of about 815° C. to about 900° C. and quenched to a temperature of about 370° C. to about 510°C., the strap having a seal joint break strength of about 4350 pounds when the strap has a width of about one inch and a thickness of 0.030 inches.

5. The strap in accordance with claim 4 wherein the strap is preheated to a temperature of about 370° C. to about 510° C. prior to heating.

6. The strap in accordance with claim 4 wherein the tensile strength is about 180 KSI.

7. A method for making a high strength strap comprising the steps of:

forming a steel strap having a composition of 0.30 to 0.36 percent carbon, 0.90 to 1.25 percent manganese, and 0.75 to 1.10 percent silicon;

heating the strap to a temperature of about about 815° C. to about 900° C.; and quenching the heated strap to a temperature of about 370° C. to about 510°C., wherein the heat treated and quenched strap has a tensile strength of at least about 170 KSI, and an elongation of at least about 6.5 percent, and wherein the strap has a seal joint break strength of about 4350 pounds when the strap has a width of about one inch and a thickness of 0.030 inches.

8. The method in accordance with claim 7 including the step of preheating the strap to a temperature of about 370° C. to about 510° C. prior to the heating step.

9. The method in accordance with claim 7 wherein the steel strap is cold rolled prior to the heating step.

* * * * *